US010856364B2

(12) United States Patent
Watanabe et al.

(10) Patent No.: US 10,856,364 B2
(45) Date of Patent: Dec. 1, 2020

(54) HEAT GENERATING APPARATUS

(71) Applicant: KURABE INDUSTRIAL CO., LTD., Hamamatsu-shi (JP)

(72) Inventors: Hironori Watanabe, Shizuoka-ken (JP); Kazuya Kokubo, Shizuoka-ken (JP); Muneaki Ikuma, Shizuoka-ken (JP); Junpei Tanaka, Shizuoka-ken (JP)

(73) Assignee: KURABE INTERNATIONAL CO. LTD., Hamamatsu (JP)

( * ) Notice: Subject to any disclaimer, the term of this patent is extended or adjusted under 35 U.S.C. 154(b) by 0 days.

(21) Appl. No.: 16/627,145

(22) PCT Filed: Jun. 26, 2018

(86) PCT No.: PCT/JP2018/024156
§ 371 (c)(1),
(2) Date: Dec. 27, 2019

(87) PCT Pub. No.: WO2019/004193
PCT Pub. Date: Jan. 3, 2019

(65) Prior Publication Data

US 2020/0163163 A1 May 21, 2020

(30) Foreign Application Priority Data

Jun. 28, 2017 (JP) ..... 2017-126382

(51) Int. Cl.
*H05B 3/03* (2006.01)
*H01C 1/014* (2006.01)
(Continued)

(52) U.S. Cl.
CPC ..... *H05B 3/03* (2013.01); *H01C 1/014* (2013.01); *H01C 1/1406* (2013.01); *H01C 7/02* (2013.01);
(Continued)

(58) Field of Classification Search
CPC ... H05B 3/03; H05B 3/06; H05B 3/14; H01C 1/014; H01C 1/1406; H01C 7/02
See application file for complete search history.

(56) References Cited

U.S. PATENT DOCUMENTS 6,229,123 B1 * 5/2001 Kochmaan ..... A41D 13/0051 219/529
8,965,187 B2 * 2/2015 Borgmeier ..... H05B 3/46 392/480
(Continued)

FOREIGN PATENT DOCUMENTS

JP S5430673 Y2 9/1979
JP H08306469 A 11/1996
(Continued)

OTHER PUBLICATIONS

ISA Japan Patent Office, International Search Report Issued in Application No. PCT/JP2018/024156, dated Oct. 2, 2018, WIPO, 4 pages.

*Primary Examiner* — Kyung S Lee
(74) *Attorney, Agent, or Firm* — McCoy Russell LLP

(57) ABSTRACT

The heat generating apparatus according to the present invention includes: a positive temperature coefficient thermistor heat generating element including an electrode layer; a first electrode terminal; a second electrode terminal; a holder configured to house the positive temperature coefficient thermistor heat generating element; and a heat conductive sheet, in which the heat conductive sheet includes a graphite particle and a polymer compound, a major axis direction of the graphite particle is substantially orthogonal to the surface of the positive temperature coefficient thermistor heat generating element, and the positive temperature coefficient thermistor heat generating element and the holder are
(Continued)

assembled in a state in which they are biased so as to apply pressure to the heat conductive sheet.

5 Claims, 4 Drawing Sheets

(51) Int. Cl.

| | |
|---|---|
| ***H01C 1/14*** | (2006.01) |
| ***H01C 7/02*** | (2006.01) |
| ***H05B 3/06*** | (2006.01) |
| ***H05B 3/14*** | (2006.01) |

(52) U.S. Cl.
CPC ..... *H05B 3/06* (2013.01); *H05B 3/14* (2013.01); *H05B 2203/02* (2013.01)

(56) References Cited

U.S. PATENT DOCUMENTS

| | | | | |
|---|---|---|---|---|
| 9,360,147 | B2 * | 6/2016 | Schwarzkopf | F16L 53/34 |
| 2010/0038356 | A1 * | 2/2010 | Fukuda | H01C 7/021 219/549 |
| 2012/0234421 | A1 * | 9/2012 | Powell | F16L 25/01 138/33 |
| 2013/0014832 | A1 * | 1/2013 | Ida | F01N 3/32 137/334 |
| 2014/0293626 | A1 * | 10/2014 | Yoshikawa | H01L 23/3737 362/382 |
| 2015/0240693 | A1 * | 8/2015 | Birman | F24H 1/102 392/488 |
| 2016/0033165 | A1 | 2/2016 | Okada et al. | |
| 2017/0001492 | A1 * | 1/2017 | Ito | B60H 1/00985 |

FOREIGN PATENT DOCUMENTS

| | | | |
|---|---|---|---|
| JP | H09148050 | A | 6/1997 |
| JP | 2790680 | B2 | 8/1998 |
| JP | 2005019595 | A | 1/2005 |
| JP | 3804695 | B2 | 8/2006 |
| JP | 5247401 | B2 | 7/2013 |
| JP | 5381102 | B2 | 10/2013 |
| JP | 2016033358 | A | 3/2016 |
| JP | 2017078394 | A | 4/2017 |

* cited by examiner

HEAT GENERATING APPARATUS

CROSS-REFERENCE TO RELATED APPLICATIONS

The present application is a U.S. National Phase of International Patent Application Serial No. PCT/JP2018/024156 entitled "HEATING DEVICE," filed on Jun. 26, 2018. International Patent Application Serial No. PCT/JP2018/024156 claims priority to Japanese Patent Application No. 2017-126382 filed on Jun. 28, 2017. The entire contents of each of the above-referenced applications are hereby incorporated by reference for all purposes.

TECHNICAL FIELD

The present invention relates to a positive temperature coefficient thermistor (hereinafter referred to as PTC) heat generating apparatus used for, for example, heat retention, heating, warming, and freezing prevention, and in particular, to a heat generating apparatus capable of efficiently heating an object to be heated and making the heat distribution uniform.

BACKGROUND ART

A PTC heat generating element has been used in the conventional field of heat generating bodies. This is because a PTC heat generating element has a specific resistance value at a temperature below a predetermined temperature (Curie temperature), thereby acting as a heat generating element, and it has a self-temperature control function of cutting energization by sharply increasing the resistance value at a predetermined temperature (Curie temperature) or higher, and thus it is extremely safe. By connecting a pair of electrode terminals to a PTC heat generating element having such characteristics, performing an appropriate insulation treatment, and arranging the PTC heat generating element in various housings, it is possible to obtain a suitable PTC heat generating apparatus such as a heater for heat retention and heating and a heater for freezing prevention for various devices. Further, such a PTC heat generating apparatus is attached to a pipe for transferring a liquid, gas, or the like, and can be used for, for example, heat retention, heating, and warming of the pipe, and prevention of freezing of the pipe. Examples of the related art related to the present invention include Patent Literature 1 to 5.

CITATION LIST

Patent Literature

Patent Literature 1: Japanese Unexamined Patent Application Publication No. 2016-33358

Patent Literature 2: Japanese Patent No. 5247401

Patent Literature 3: Japanese Patent No. 3804695

Patent Literature 4: Japanese Unexamined Patent Application Publication No. H8-306469

Patent Literature 5: Japanese Patent No. 5381102

SUMMARY OF INVENTION

Technical Problem

The PTC heat generating apparatus as described above can perform self-temperature control, and thus the size thereof can be reduced, so that it has already been put on the market and put to practical use. However, as the PTC heat generating element does not have flexibility, it is not sufficient for achieving an efficient heating of a part to be heated such as a pipe, and making heat distribution uniform, the achievement of which has been desired.

The present invention has been made to solve the above-described problems of the related art, and an object thereof is to provide a heat generating apparatus capable of efficiently heating an object to be heated and making the heat distribution uniform.

Solution to Problem

In order to achieve the aforementioned object, a heat generating apparatus according to one aspect of the present invention includes: a positive temperature coefficient thermistor heat generating element including an electrode layer; a first electrode terminal; a second electrode terminal; a holder configured to house the positive temperature coefficient thermistor heat generating element; and a heat conductive sheet, in which the heat conductive sheet includes a graphite particle and a polymer compound, and a major axis direction of the graphite particle is substantially orthogonal to the surface of the positive temperature coefficient thermistor heat generating element, and the positive temperature coefficient thermistor heat generating element and the holder are assembled in a state in which they are biased so as to apply pressure to the heat conductive sheet.

Further, the first electrode terminal may include a first spring terminal, the second electrode terminal may include a second spring terminal, and the positive temperature coefficient thermistor heat generating element and the holder may be brought into a state in which they are biased so as to apply pressure to the heat conductive sheet by an elastic force of the first spring terminal and the second spring terminal.

Further, the first spring terminal and the second spring terminal may be each formed of a metal plate, and each may include a supporting part and an biasing part that is formed at least at one end of each of the terminals, the biasing part may include a first bent part, a second bent part bent in a direction opposite to a direction in which the first bent part is bent, and a plane end part formed so as to be substantially orthogonal to a longitudinal direction of the supporting part and to extend toward an end of the biasing part opposite to the supporting part, and the first spring terminal and the second spring terminal may be located so that a direction in which the first bent part is bent in the first spring terminal is opposite to a direction in which the first bent part is bent in the second spring terminal.

Further, the positive temperature coefficient thermistor heat generating element, the first electrode terminal, the second electrode terminal, the holder, and the heat conductive sheet may be arranged in a housing having at least one open side, a lid part may be located at an opening of the housing via a packing, and the housing may be fixed to the lid part by a screw, so that a structure capable of adjusting an biasing pressure by an amount of fastening of the screw and an elastic force of the packing may be formed.

Further, the electrode layer can be composed of a pair of electrode layers, the first electrode terminal may include the first spring terminal and a first clip terminal, the second electrode terminal may include the second spring terminal and a second clip terminal, and the pair of electrode layers may be both formed on one main surface of the positive temperature coefficient thermistor heat generating element, and may be covered with the first clip terminal, the second clip terminal, and an adhesive.

Further, the holder may be formed of silicon carbide, and an oxide film may be provided on the outer surface of the holder.

Further, the holder may be in a state in which at least a part of the oxide film is peeled off from the surface of the holder that comes into contact with the heat conductive sheet.

Advantageous Effects of Invention

In the heat generating apparatus according to the present invention, by using a heat conductive sheet and applying pressure thereto, it is possible to reduce heat loss related to heat conduction and increase heat conductivity. Accordingly, the heat generating apparatus according to the present invention can efficiently heat an object to be heated, and make the heat distribution substantially uniform.

DESCRIPTION OF EMBODIMENTS

Embodiments of the present invention will be described hereinafter with reference to FIGS. 1 to 4. In this embodiment, an example will be described in which it is assumed that a pipe is used as an object to be heated, and a heat generating apparatus according to the present invention is attached to the pipe.

Figure 1:
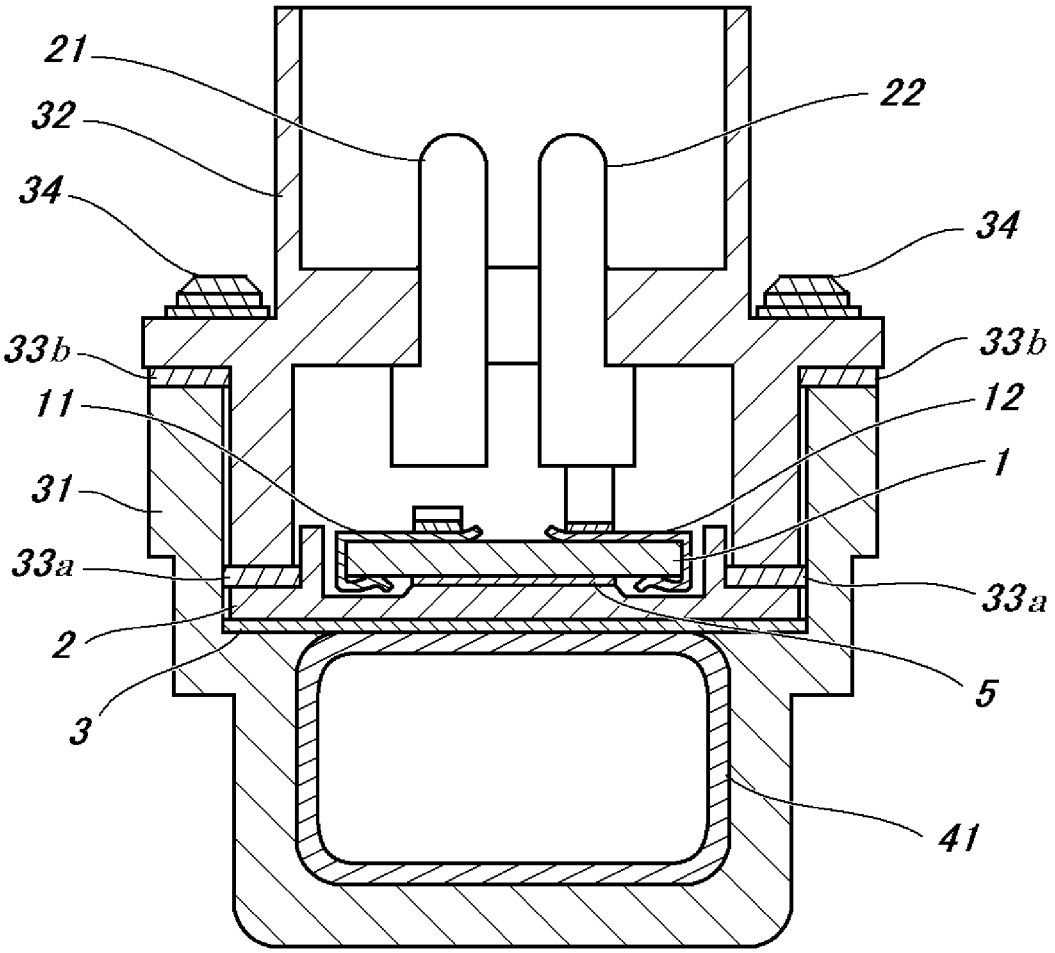
FIG. 1 is a cross-sectional view showing a state in which a heat generating apparatus according to one aspect of the present invention is attached to an object to be heated.
Figure 2:
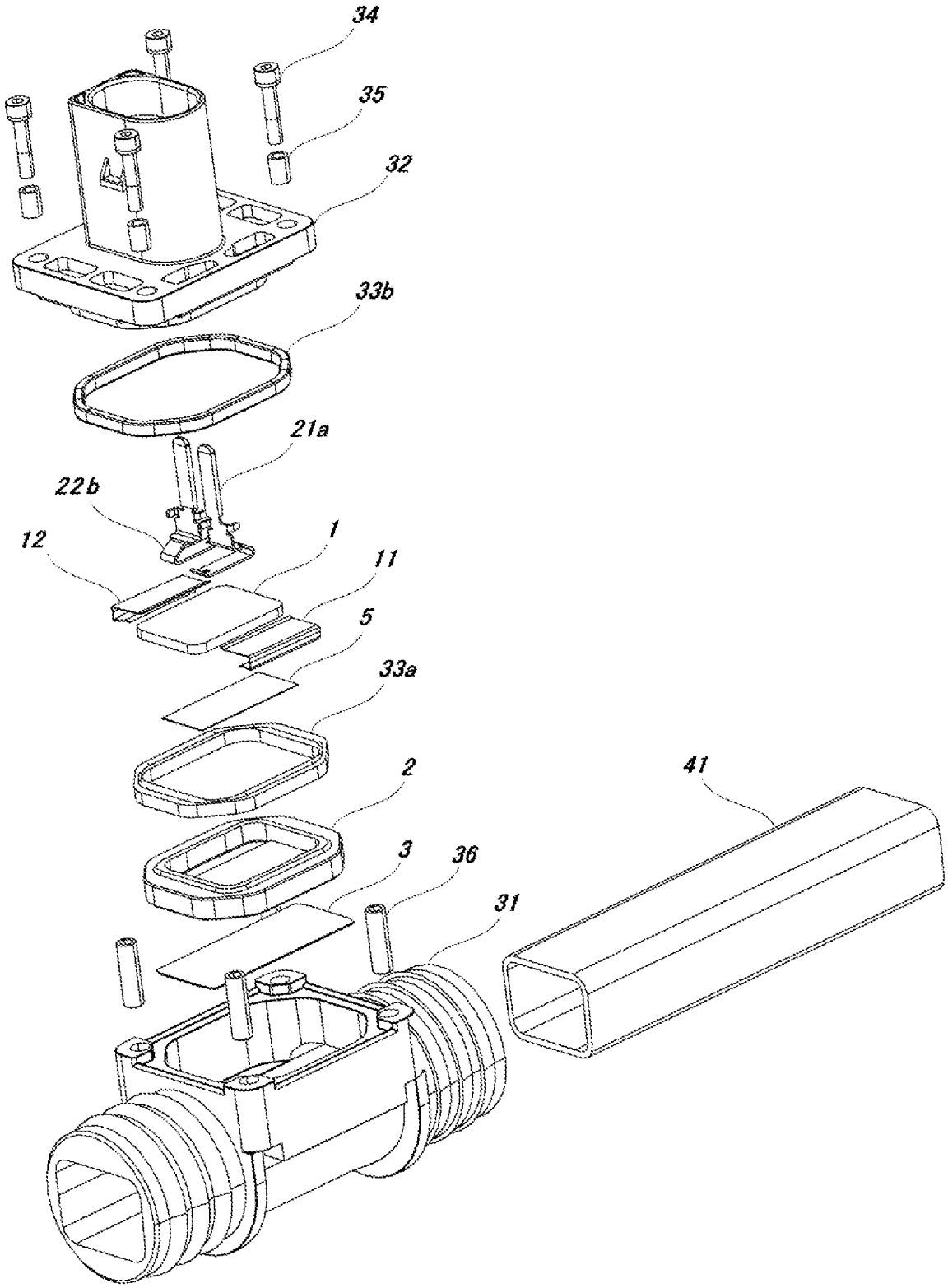
FIG. 2 is a perspective view showing a state in which the heat generating apparatus according to the one aspect of the present invention is assembled.
Figure 3:
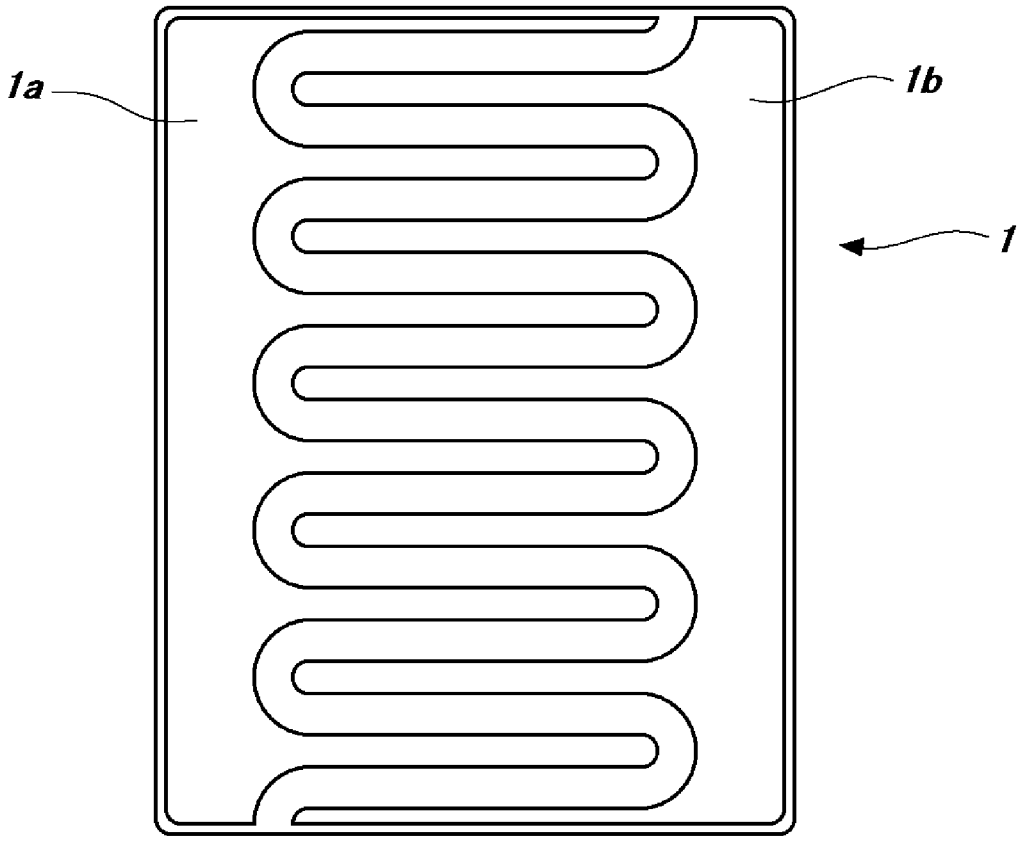
FIG. 3 is a plan view showing a PTC heat generating element according to the one aspect of the present invention.

A PTC heat generating element 1 includes a barium titanate-based ceramic element formed in a substantially square plate shape having a length of 14.0 mm, a width of 18.5 mm, and a thickness of 1.5 mm, and includes two main surfaces and four side surfaces. As shown in FIG. 3, on one main surface of the PTC heat generating element 1, two electrodes are alternately formed in a comb pattern using silver paste, and these electrodes are respectively referred to as an electrode layer 1*a*, and an electrode layer 1*b*. One of the electrode layer 1*a* and the electrode layer 1*b* is a positive electrode, and the other is a negative electrode. Note that the material of the PTC heat generating element may be appropriately selected according to the required heat generation characteristics (e.g., Curie temperature).

In this embodiment, a first electrode terminal includes a first clip terminal 11 and a first spring terminal 21, and a second electrode terminal includes a second clip terminal 12 and a second spring terminal 22. The first and the second clip terminals 11 and 12 are each made of a phosphor bronze plate having a thickness of 0.15 mm and an excellent spring elasticity, and the cross sections thereof are sideways U-shapes in each of which the tip is slightly narrower than the base. Therefore, when the first and the second clip terminals 11 and 12 are attached to the PTC heat generating element 1, these clip terminals are fixed to the PTC heat generating element 1 due to their restoring force. The PTC heat generating element 1 is fitted into the sideways U-shaped openings of each clip terminal so that the first clip terminal 11 comes into contact with the electrode layer 1*a* and the second clip terminal 12 comes into contact with the electrode layer 1*b*.

A holder 2 according to this embodiment is made of silicon carbide, and has a case shape for housing the PTC heat generating element 1 to which the first and the second clip terminals 11 and 12 are attached. The surface of the PTC heat generating element 1 on which the electrode layers 1*a* and 1*b* are formed comes into contact with the holder 2. Note that the PTC heat generating element 1 may be fixed to the holder 2 with an adhesive 5 such as a silicone-based adhesive. In particular, the electrode layers 1*a* and 1*b* are preferably covered with the first electrode terminal (the first clip terminal 11, the first clip terminal 21), the second electrode terminal (the second clip terminal 12, the second clip terminal 22), and the adhesive 5, because the electrode layers 1*a* and 1*b* can be protected and migration can be prevented.

A heat conductive sheet 3 is located adjacent to the bottom surface of the holder 2 housing the PTC heat generating element 1. The heat conductive sheet 3 includes graphite particles and a polymer compound, and is formed so that the major axis direction of the graphite particle is substantially orthogonal to the surface of the positive temperature coefficient thermistor heat generating element 1. As the heat conductive sheet 3, for example, the one disclosed in Patent Literature 5 can be used.

A housing 31 used in this embodiment is made of nylon 66, one surface of the housing 31 is open, and a through hole is formed in the one surface so as to be parallel thereto. A copper pipe having a substantially rectangular cross section is fitted into the through hole as an object to be heated 41. An annular projection for connecting the housing 31 to another pipe member is formed on an outer periphery of the part of the housing 31 in which the through hole is formed. Alternatively, a connection structure such as a flange and threading may be formed on the above outer periphery.

Figure 4:
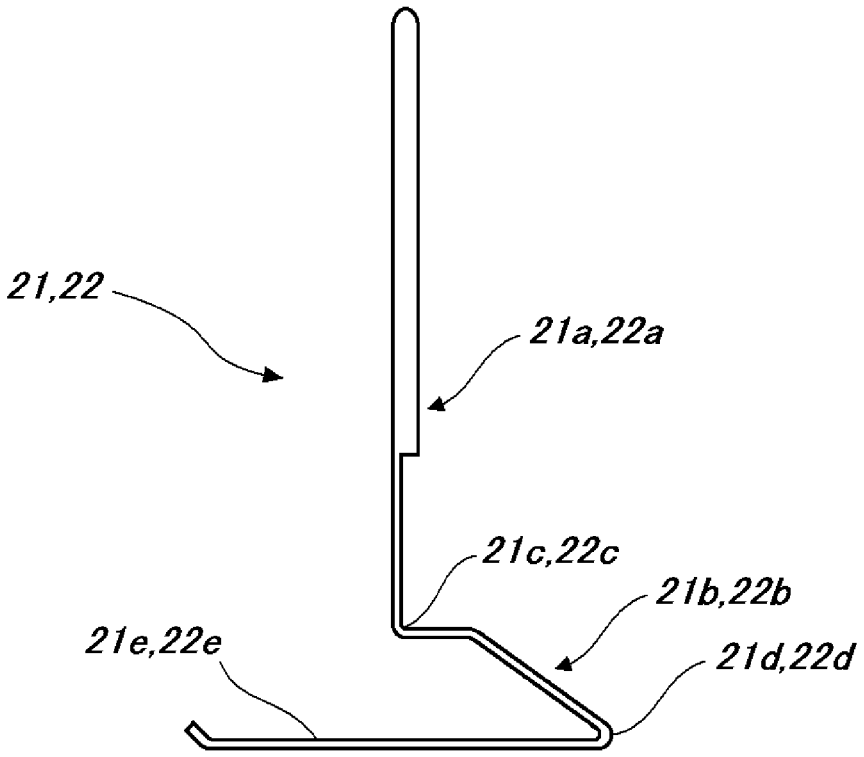
FIG. 4 is a side view showing a first spring terminal or a second spring terminal according to the one aspect of the present invention.

The first and the second spring terminals 21 and 22 are each formed of a beryllium copper plate having a thickness of 0.3 mm and an excellent spring elasticity, and respectively include supporting parts 21*a* and 22*a* and biasing parts 21*b* and 22*b* formed in at least one end of each of the terminals as shown in FIG. 4. The biasing parts 21*b* and 22*b* respectively include first bent parts 21*c* and 22*c* formed so as to be substantially perpendicular to the longitudinal direction of the supporting parts 21*a* and 22*a*, plane end parts 21*e*, 22*e* formed so as to be substantially orthogonal to the longitudinal direction of the supporting parts 21*a* and 22*a*, and second bent parts 21*d* and 22*d* that are respectively formed between the first bent parts 21*c* and 22*c* and the plane end parts 21*e* and 22*e*, and that are respectively bent in the direction opposite to the direction in which the first bent parts 21*c* and 22*c* are bent. Further, the plane end parts 21*e* and 22*e* respectively extend from the second bent parts toward the ends of the plane end parts 21*e* and 22*e* opposite to the supporting parts 21*a* and 22*a*. The supporting parts 21*a* and 22*a* have a stepped shape in which the proximal sides of the biasing parts 21*b* and 22*b* are thin and the distal sides of the same are thick, respectively. The stepped part may be formed by cutting off or may be formed by bending. The position of the stepped part is designed by taking the distance between a lid part 32 and the PTC heat generating element 1, the elastic forces of the first spring terminal 21 and the second spring terminal 22, and the pressure required for the heat conductive sheet 3 into consideration.

The lid part 32 used in this embodiment is made of nylon 66, and has a shape that covers the opening of the housing 31. The lid part 32 has a part extending along the inner wall of the housing 31. Screw holes for fastening the housing 31 to the lid part 32 are formed at the four corners of the lid part 32. Further, holes for inserting into the first and the second spring terminals 21 and 22 are formed at a substantially center part of the lid part 32.

In this embodiment, a small-diameter packing 33*a* and a large-diameter packing 33*b* are used. These are made of fluoro rubber, the small-diameter packing 33*a* has an annular shape that matches the opening defined by the inner wall of the housing 31, and the large-diameter packing 33*b* has an annular shape so that it can be located on the side wall of the housing 31.

The assembly of these components will be described below. The housing 31 includes a copper pipe that is the object to be heated 41 fitted thereinto, and the copper pipe serves as the bottom thereof. Further, on this copper pipe, the heat conductive sheet 3, the holder 2, and the PTC heat generating element 1 to which the first and the second clip terminals 11 and 12 are attached are sequentially arranged. As described above, the surface of the PTC heat generating element 1 on which the electrode layers 1*a* and 1*b* are formed comes into contact with the holder 2. The packing 33*a* is located on the holder 2 so as to be along the inner wall of the housing 31 and so as to surround the PTC heat generating element 1. The packing 33*b* is located on the side wall of the housing 31. Further, the first and the second spring terminals 21 and 22 are inserted into the holes formed in the lid part 32, and the first and the second spring terminals 21 and 22 are extended above and below the lid part 32. At this time, the first and the second spring terminals 21 and 22 are arranged so that the direction in which the first bent part 21*c* of the first spring terminal 21 is bent is opposite to the direction in which the first bent part 22*c* of the second spring terminal 22 is bent. Further, as described above, the supporting parts 21*a* and 22*a* of the respective first and the second spring terminals 21 and 22 each have a stepped shape, and this stepped part functions as a stopper, and thus the first and the second spring terminals 21 and 22 cannot be inserted beyond the stepped part. It is obvious that the stopper may be formed by a method other than stepping, such as pinning, bending, and adhesion. In this state, the lid part 32 is located so as to cover the housing 31, screws 34 having a hexagonal hole of M2×10 mm (length) are screwed in each M2 insert nut 35 fitted into the four corners of the lid part 32 and each M2 insert nut 36 fitted into the four corners of the housing 31, so that the housing 31 is fastened and fixed to the lid part 32. Note that the first and the second spring terminals 21 and 22 extending above the lid part 32 are connected to a power supply through a connector and a lead wire (not shown).

According to the aforementioned structure, due to energization by elastic repulsion of the biasing parts 21*b* and 22*b* of the first and the second spring terminals 21 and 22 and the packings 33*a* and 33*b*, the first spring terminal 21 comes into contact with the first clip terminal 11, the second spring terminal 22 comes into contact with the second clip terminal 12, and further the heat conductive sheet 3 is compressed by receiving pressure via the PTC heat generating element 1 and the holder 2. This heat conductive sheet 3 has a high heat conductivity due to compression. Accordingly, the heat conductivity increases while the gap between the object to be heated 41 and the holder 2 is closed, thereby enabling the object to be heated 41 to be efficiently heated. Further, by using the elastic repulsion by the biasing parts 21*b* and 22*b* and the packings 33*a* and 33*b* of the first and the second spring terminals 21 and 22, it is possible to adjust the pressure on the heat conductive sheet by the amount of tightening the screw 34, prevent a bias of the pressure distribution, and perform energization with a uniform pressure. As the heat conductivity of the heat conductive sheet 3 changes depending on the degree of compression, the heat distribution can be made uniform by making the pressure distribution uniform. In particular, if the first spring terminal 21 and the second spring terminal 22 are arranged so that the direction in which the first bent part 21*c* of the first spring terminal 21 is bent is opposite to the direction in which the first bent part 22*c* of the second spring terminal 22 is bent, the pressure received by the heat conductive sheet 3 becomes more uniform.

The aforementioned embodiment is an example, and there are other conceivable aspects as shown below.

In the aforementioned embodiment, although the copper pipe that is the object to be heated 41 is fitted into the housing 31 in a state in which the object to be heated penetrates the housing, it is obvious that the object to be heated may be located outside of the housing. In this case, the heat generating apparatus is configured so that the heat conductive sheet is located between the PTC heat generating element and the object to be heated.

Further, the copper pipe that is the object to be heated 41 in the aforementioned embodiment may be used as merely a soaking member, and another pipe may be arranged as an object to be heated in this soaking member. Furthermore, as the object to be heated 41, a pipe having a plurality of flow paths shown in Patent Literature 1 may be used.

Further, in the aforementioned embodiment, although two electrode layers, that is, the electrode layers 1*a* and 1*b*, are formed on one main surface of the PTC heat generating element 1, the electrode layers 1*a* and 1*b* may be formed on each of both main surfaces of the PTC heat generating element. In this case, one of the first clip terminal 11 and the second clip terminal 12 can be omitted. Further, electrode layers may be formed on the side surface and one main surface of the PTC heat generating element so that they are continuously connected with the electrode layer formed on the other main surface of the PTC heat generating element. By doing so, one or both of the first clip terminal 11 and the second clip terminal 12 can be omitted. Further, the material of the electrode layers 1*a* and 1*b* is not limited to silver paste, and for example, the electrode layers 1*a* and 1*b* can be formed using various materials such as gold, copper, aluminum, and a conductive resin by other methods such as plating and vapor deposition.

The material of the first and the second clip terminals 11 and 12, and the first and the second spring terminals 21 and 22 is not limited to a particular material as long as it has spring elasticity and functions as an electrode. For example, the first and the second clip terminals 11 and 12, and the first and the second spring terminals 21 and 22 can be formed using metal plates such as a stainless steel plate, a phosphor bronze plate, a beryllium copper plate, a nickel plated brass plate, a tin plated brass plate, and a silver plated brass plate. Among these metal plates, a stainless steel plate, a beryllium copper plate, a phosphor bronze plate, and the like are particularly preferable because they can sufficiently retain their spring elasticity even when they are subjected to a thermal cycle over a long period of time.

As the material of the holder 2, for example, various ceramics such as alumina, zirconia, silicon carbide, and silicon nitride, a resin material, and a rubber material can be used. The holder 2 is preferably made of an insulating material. However, especially when using a heating device at a low voltage, it is possible to further improve the heat generation characteristics of the heat generating apparatus by giving priority to a high heat conductivity and using silicon carbide that is a semiconductor. Further, the holder 2 may be formed using a semiconductor material or a conductor material of which the outer surface is coated with an insulating material.

For example, when the holder 2 is formed of silicon carbide, the surface of the silicon carbide is oxidized to form a silicon oxide film on the outer surface of the holder 2. As a result, this silicon oxide film forms an insulating film of about $10^7\Omega$ on the outer surface of the holder 2. Further, even when a silicon oxide film is formed on the outer surface of the holder 2 as described above, it is possible to increase the heat conductivity of the holder 2 by polishing the surface of the holder 2 that comes into contact with the heat conductive sheet 3 so that at least some of the silicon oxide film is peeled off and making the surface roughness lower than those of the other surfaces.

The material of the housing 31 and the lid part 32 is not limited to a particular material but preferably has an excellent heat resistance, and insulation properties. For example, various resin materials such as nylon, aramid, polypropylene, polyester, polystyrene, polyphenylene sulfide, and polycarbonate can be used.

It is preferred that the material of the packings 33*a* and 33*b* be flexible and elastic, and have an excellent oil resistance and a heat resistance, and examples thereof include various rubber materials such as fluoro rubber, silicone rubber, and acrylic rubber.

As described above, according to the present invention, it is possible to provide a heat generating apparatus capable of efficiently heating an object to be heated and making the heat distribution substantially uniform. Such a heat generating apparatus can be used, for example, as a heater for heat retention, heating, and warming of home appliances, housing equipment, an automobile engine part, a plant, and a pipe, and prevention of freezing of the same. Further, it can be suitably used as a heater for liquid evaporation of aromatics and various drugs.

This application is based upon and claims the benefit of priority from Japanese patent application No. 2017-126382, filed on Jun. 28, 2017, the disclosure of which is incorporated herein in its entirety by reference.

REFERENCE SIGNS LIST

1 PTC HEAT GENERATING ELEMENT
1*a*, 1*b* ELECTRODE LAYER
2 HOLDER
3 HEAT CONDUCTIVE SHEET
5 ADHESIVE
11 FIRST CLIP TERMINAL
12 SECOND CLIP TERMINAL
21 FIRST SPRING TERMINAL
22 SECOND SPRING TERMINAL
31 HOUSING
32 LID PART
33*a*, 33*b* PACKING
41 OBJECT TO BE HEATED

The invention claimed is:

1. A heat generating apparatus comprising:

a positive temperature coefficient thermistor heat generating element comprising an electrode layer;

a first electrode terminal;

a second electrode terminal;

a holder configured to house the positive temperature coefficient thermistor heat generating element; and a heat conductive sheet, wherein the heat conductive sheet includes a graphite particle and a polymer compound, and a major axis direction of the graphite particle is substantially orthogonal to the surface of the positive temperature coefficient thermistor heat generating element, and the positive temperature coefficient thermistor heat generating element and the holder are assembled in a state in which they are biased so as to apply pressure to the heat conductive sheet, the first electrode terminal comprises a first spring terminal, the second electrode terminal comprises a second spring terminal, and the positive temperature coefficient thermistor heat generating element and the holder apply pressure to the heat conductive sheet by an elastic force of the first spring terminal and the second spring terminal.

2. The heat generating apparatus according to claim 1, wherein the first spring terminal and the second spring terminal are each formed of a metal plate, and each comprise a supporting part and an biasing part that is formed at least at one end of each of the terminals, and the biasing part includes a first bent part, a second bent part bent in a direction opposite to a direction in which the first bent part is bent, and a plane end part formed so as to be substantially orthogonal to a longitudinal direction of the supporting part and to extend toward an end of the biasing part opposite to the supporting part, and the first spring terminal and the second spring terminal are located so that a direction in which the first bent part is bent in the first spring terminal is opposite to a direction in which the first bent part is bent in the second spring terminal.

3. The heat generating apparatus according to claim 1, wherein the positive temperature coefficient thermistor heat generating element, the first electrode terminal, the second electrode terminal, the holder, and the heat conductive sheet are arranged in a housing having at least one open side, a lid part is located at an opening of the housing via a packing, and the housing is fixed to the lid part by a screw, thereby forming a structure capable of adjusting an biasing pressure by an amount of fastening of the screw and an elastic force of the packing.

4. The heat generating apparatus according to claim 1, wherein the electrode layer is composed of a pair of electrode layers, the first electrode terminal comprises the first spring terminal and a first clip terminal, the second electrode terminal comprises the second spring terminal and a second clip terminal, and the pair of electrode layers are both formed on one main surface of the positive temperature coefficient thermistor heat generating element, and are covered with the first clip terminal, the second clip terminal, and an adhesive.

5. A heat generating apparatus comprising:

a positive temperature coefficient thermistor heat generating element comprising an electrode layer;

a first electrode terminal;

a second electrode terminal;

a holder configured to house the positive temperature coefficient thermistor heat generating element; and a heat conductive sheet, wherein the heat conductive sheet includes a graphite particle and a polymer compound, and a major axis direction of the graphite particle is substantially orthogonal to the surface of the positive temperature coefficient thermistor heat generating element, the positive temperature coefficient thermistor heat generating element and the holder are assembled in a state in which they are biased so as to apply pressure to the heat conductive sheet, and the holder is formed of silicon carbide, and an oxide film is provided on the outer surface of the holder and in a state in which at least a part of the oxide film is peeled off from the surface of the holder that comes into contact with the heat conductive sheet.

* * * * *